United States Patent [19]

Takeda et al.

[11] Patent Number: 4,741,706

[45] Date of Patent: May 3, 1988

[54] LOCKED CONNECTOR

[75] Inventors: Mitsuru Takeda; Sadao Kuboi, both of Mooka, Japan

[73] Assignee: Daiichi Denshi Kogyo Kabushiki Kaisha, Tokyo, Japan

[21] Appl. No.: 21,995

[22] Filed: Mar. 5, 1987

[30] Foreign Application Priority Data

| | | | |
|---|---|---|---|
| Mar. 6, 1986 | [JP] | Japan | 61-49355 |
| Oct. 17, 1986 | [JP] | Japan | 61-246910 |
| Oct. 30, 1986 | [JP] | Japan | 61-259414 |

[51] Int. Cl.[4] ..... H01R 13/625

[52] U.S. Cl. ..... 439/318; 439/321

[58] Field of Search ..... 439/312, 313, 314, 315, 439/316, 317, 318, 319, 320, 321

[56] References Cited

U.S. PATENT DOCUMENTS

| | | | |
|---|---|---|---|
| 3,462,727 | 8/1969 | Blight et al. | 439/321 |
| 3,517,371 | 6/1970 | Buckley | 439/321 |
| 3,808,580 | 4/1974 | Johnson | 439/321 |
| 3,917,373 | 11/1975 | Peterson | 439/321 |
| 4,257,663 | 3/1981 | Brush et al. | 439/321 |
| 4,272,144 | 6/1981 | Brush et al. | 439/321 |
| 4,703,988 | 11/1987 | Raux et al. | 439/321 |

FOREIGN PATENT DOCUMENTS

| | | |
|---|---|---|
| 56-13679 | 2/1981 | Japan . |
| 59-8034 | 2/1984 | Japan . |
| 59-8033 | 2/1984 | Japan . |
| 2023358 | 12/1939 | United Kingdom . |
| 857344 | 12/1960 | United Kingdom . |

*Primary Examiner*—John McQuade

*Attorney, Agent, or Firm*—Silverman, Cass, Singer & Winburn, Ltd.

[57] ABSTRACT

A locked connector for use in electric connectors, optical fiber connectors and the like, includes receptacle means having a receptacle shell, coupling means engaging the receptacle means with relative rotations, plug shell means having a plug shell engaging the receptacle shell with relative movements in their axial directions but against relative rotation, back-up means permitting the coupling means and the plug shell means to rotatably engage with each other, and detent means for holding said receptacle means and the plug shell means in their fitted position and permitting the receptacle means and the plug shell means to disengage from the fitted position by rotating the coupling means relative to the plug shell means with a force. The detent means comprises a detent ring encircling the plug shell and having a springiness. The detent ring comprises detent keys for rotating together with the coupling means to form a detent mechanism in connection with the plug shell, and detent projections extending in an axial direction of the detent ring. The plug shell comprises a plug flange encircling the plug shell. The plug flange is formed with detent recesses for receiving the detent projections of the detent ring. A complete connection of the connector is detected by a sound generated when the detent projections fall into the detent recesses. As a force is required to remove the detent projections from the detent recesses, any unintentional disconnection of the connector due to vibration or the like is prevented.

5 Claims, 19 Drawing Sheets

LOCKED CONNECTOR

BACKGROUND OF THE INVENTION

This invention relates to a connector used as an electric or optical fiber connector adapted to be prevented from disconnection due to mechanical vibration and change in temperature or pressure, and more particularly to an improved connector which is easily detachable by a simple operation and inexpensive to manufacture with fewer parts and which is high in reliability.

It is required to have high reliability for connectors used under greatly variable conditions and subjected to mechanical vibration as when used in vehicles, aircraft, robots and the like.

With these connectors, in general, a plug is inserted into a receptacle and clamped to the receptacle by set screws with the aid of a coupling rotatable about an axis of the connector. However, no matter how the clamping by set screws is strongly effected, there is a tendency for the clamping to be loosened when subjected to vibration, resulting finally in contact failure of the connector.

Connectors intended to eliminate such disadvantages of the prior art have been disclosed in Japanese Patent Application Publications Nos. 8,033/84 and 8,034/84 and Japanese Laid-open Patent Application No. 13,679/81. For example, the connector disclosed in the Japanese Patent Application Publication No. 8,033/84 includes receptacle means having a receptacle shell, a plug shell having connecting nuts threadedly engaging the plug shell, plug means having a connecting ring housing keyed to the connecting nuts, electric contact elements adapted to do electric connection and disconnection in the receptacle and plug shells according to instruction, and fixing means on the connecting ring housing and the receptacle shell for detachably holding the electric contact elements in engaged positions. The connector further comprises display means for visually indicating the completely engaged and fixed positional relation between the receptacle means and the plug means. The display means comprises an inner annular groove formed in the connecting ring housing, a circular arc detent member having an elasticity located in the inner annular groove and means for governing relative rotating movement between the plug shell and the detent member having ends facing radially outwardly. The inner annular groove of the connecting ring housing includes sets of recesses spaced and located radially outwardly for selectively receiving the ends of the detent member. With this arrangement, when the housing is rotated into the completely engaged and fixed position, the ends of the detent member are forced out of a first set of the recesses into a second set of the recesses to generate a sound.

With this connector of the prior art, the characterizing feature lies in that when the housing is forced to be rotated, the ends of the circular arc detent member are pushed out of the first set of the recesses and into the second set of the recesses to generate the sound, thereby causing the engagement of the receptacle and plug means to completely fix the housing.

In this prior art, however, there is a problem in a great number of the parts for constituting the connector as can be seen from the claim, the detailed explanation and drawings of the Japanese Patent Application Publication No. 8,033/84.

Moreover, these many parts include those not suitable for being worked using molds as in pressforming, casting, molding and the like. This fact makes the connector expensive and limits applications of the connector.

For example, the plug shell and connecting nuts have screw threads threadedly engaged with each other, which are unable to be formed by press-forming and other working using molds. Moreover, the recesses for receiving the ends of the circular arc detent member facing radially outwardly are not formed by pressforming or other working using molds. The connector of the prior art, therefore, involves a great problem in working the parts.

SUMMARY OF THE INVENTION

It is a principal object of the invention to provide an improved locked connector which eliminates all the disadvantages of the prior art and which is easy and inexpensive to manufacture with less number of parts, capable of indicating a complete connection of the connector by a sound and preventing from disconnection due to vibration or the like.

In order to achieve this object, in a locked connector for use in electric connectors, optical fiber connectors and the like, including receptacle means having a receptacle shell, coupling means engaging the receptacle means with relative rotations, plug shell means having a plug shell engaging the receptacle shell with relative movements in their axial directions but against relative rotation, back-up means permitting said coupling means and said plug shell means to rotatably engage with each other, and detent means for holding said receptacle means and said plug shell means in their fitted position and permitting said receptacle means and said plug shell means to disengage from the fitted position by rotating said coupling means relative to said plug shell means with a force, according to the invention said detent means comprises a detent ring encircling said plug shell means and having means for rotating together with said coupling means to form a detent mechanism in connection with said plug shell, and spring means for urging said detent ring toward said plug shell.

In a preferred embodiment of the invention, the detent ring comprises detent projections extending in an axial direction of the detent ring, and the plug shell comprises a plug flange encircling the plug shell, the plug flange being formed with detent recesses for receiving the detent projections of the detent ring to form the detent means.

In another embodiment, surfaces of the plug flange in opposition to the detent ring progressively increase their thickness from one detent recess to the adjacent detent recess to form circular arc surfaces in circular directions of the plug flange and the detent recesses are located at bottoms of the circular arc surfaces.

In a further embodiment, the detent projections of the detent ring are two and located in diametrically opposed positions,and the detent recesses of the plug flange are four and located at four positions equally spaced on the plug flange.

In a preferred embodiment, the detent ring is bent to form an angle about a line connecting the two detent projections to have a springiness, thereby integrally forming the detent ring and the spring means.

With this arrangement, a complete connection of the connector is detected by a sound generated when the detent projections fall into the detent recesses. As a force is required to remove the detent projections from the detent recesses, any unintentional disconnection of the connector due to vibration or the like is prevented.

The invention will be more fully understood by referring to the following detailed specification and claims taken in connection with the appended drawings.

DESCRIPTION OF THE PREFERRED EMBODIMENTS

Figure 1:
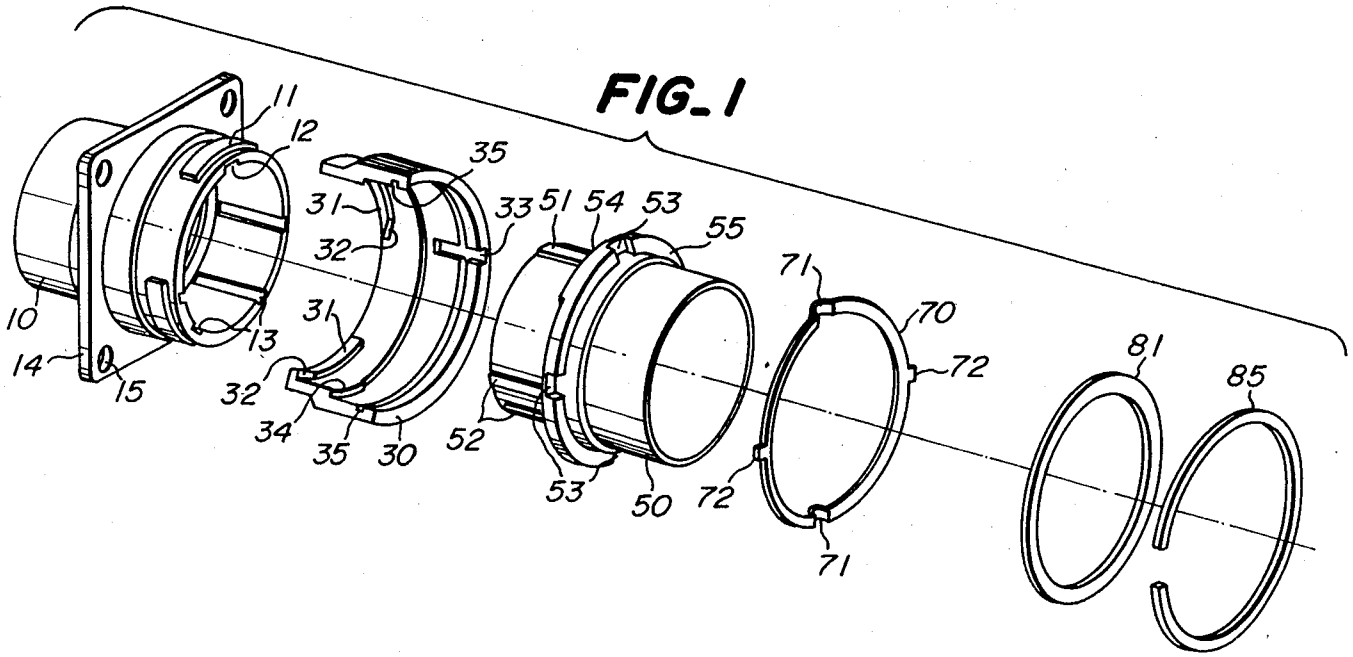
FIG. 1 is an exploded perspective view of a first embodiment of the invention.

Referring to FIG. 1 illustrating one embodiment of the invention, there is shown a receptacle shell 10 into which is inserted an insert (not shown) as first connector means having a number of socket contacts. The receptacle shell 10 comprises three lands 11 for fixing a mating member later described, a master key way 12, four key ways 13 and a mounting flange 14 formed with mounting apertures 15.

FIG. 1 illustrates a plug shell 50 as the mating member into which is inserted an insert (not shown) as second connector means having a number of pin contacts. The plug shell 50 comprises a master key 51 adapted to be fitted in the master key way 12, four keys 52 adapted to be fitted in the four key ways 13 of the receptacle shell 10, and a plug flange 55 encircling the plug shell 50. The plug flange 55 is formed with four detent recesses 53 which are in parallel with an axis of the plug shell 50 and depressed from a side surface of the plug flange 55 and are equally spaced on a circumference of the plug flange 55. The plug flange 55 is further formed with two rotation stoppers 54 extending forward from a front side of the plug flange 55.

A coupling 30 (which is cylindrical but is shown in FIG. 1 after removal of its half for the sake of clarity) is in cooperation with the plug shell 50 to enable it to be detachable from the receptacle shell 10. The coupling 30 comprises, in its inner surface, tapered lands 31 each in the form of a circular arc having a tapered portion 32, two detent key ways 33 provided in an inner surface of a rear portion of the coupling 30 in parallel with an axis of the coupling 30, rotation protrusions 34 formed in the inner surface of the coupling and extending rearward in parallel with the axis of the coupling 30, and a retainer ring groove 35 formed behind the rotation protrusions 34 in the inner surface of the coupling 30.

A detent spring ring 70 comprises two detent projections 71 extending in parallel with an axis of the detent spring ring 70 in a manner dividing the detent spring ring 70 into two equal parts, and two detent keys 72 located between the two detent projections 71 and extending radially outwardly of the detent spring ring 70.

A back-up ring 81 serves to hold the detent spring ring 70 on the rear side and is prevented from jumping out of the plug shell 50 with the aid of a retainer ring 85 fitted in the retainer ring groove 35.

Respective functions of these members above described will be explained referring to FIGS. 2*a*, 2*b* and 2*c*, FIGS. 3*a* and 3*b* and FIGS. 4*a* and 4*b* under three conditions, that is, a condition before the plug shell 50 is fitted in the receptacle shell 10 with the aid of the coupling 30, a half fitted condition before the coupling 30 is rotated but after the plug shell 50 has been fitted in the receptacle shell 10, and completely fitted condition after the coupling 30 has been rotated through a determined angle to fix the receptacle shell 10 and the plug shell 50 to each other.

Figure 2A:
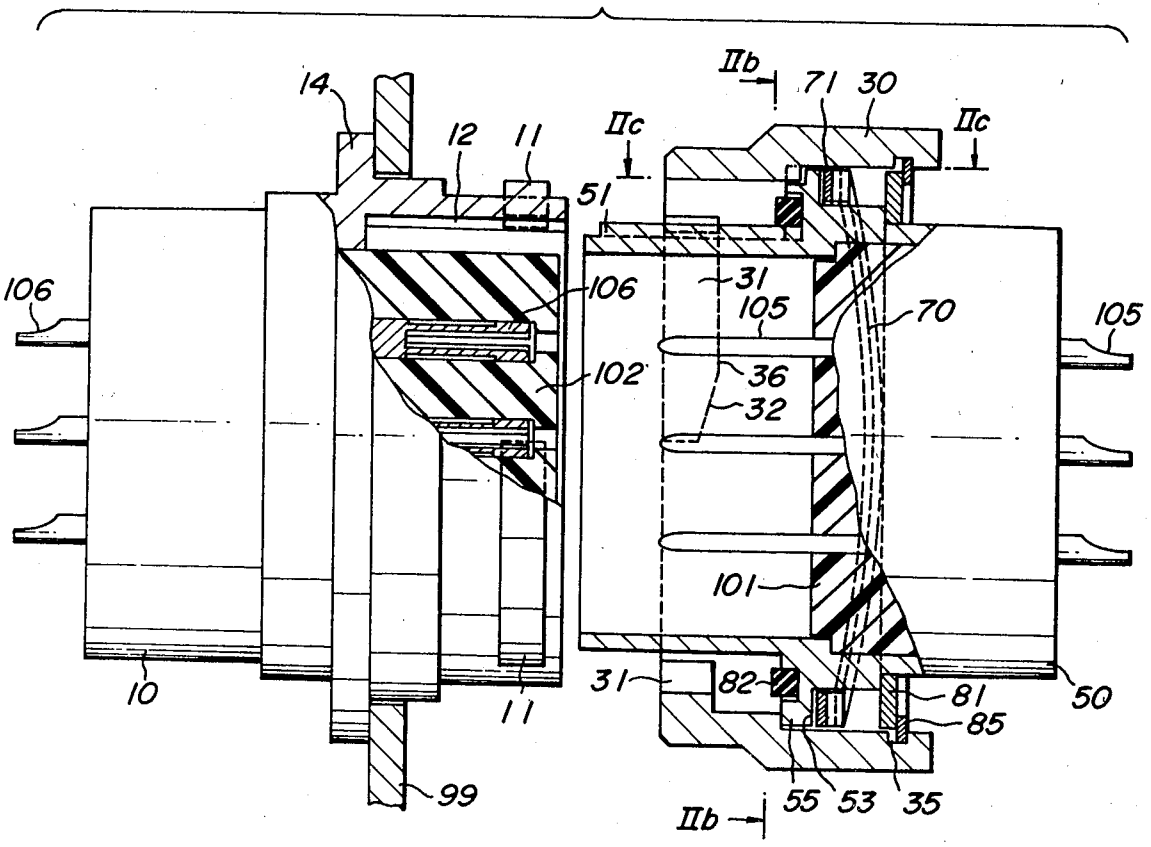
FIG. 2*a* is a partial sectional view of the connector before fitting.
Figure 2B:
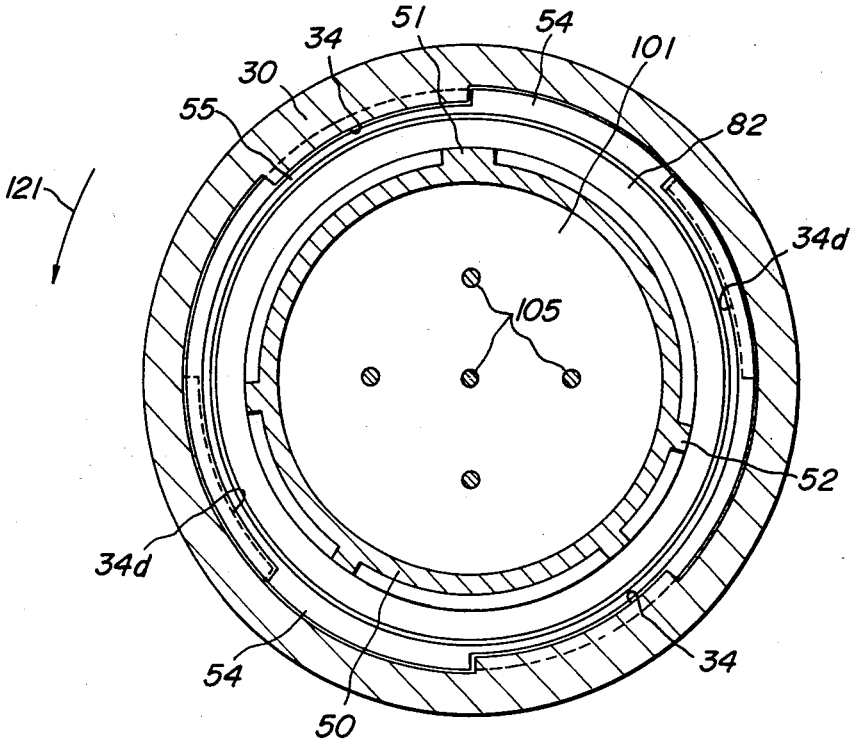
FIG. 2*b* is a sectional view taken along the line II—IIb in FIG. 2*a;*

In FIG. 2*a*, a partial sectional view illustrating the condition before fitting, the receptacle shell 10 incorporates therein an insert 102 having a number of socket contacts 106 and the plug shell 50 incorporates therein an insert 101 having a number of pin contacts 105. Reference numeral 82 denotes a gasket made of an elastomer such as an annular rubber. Reference numeral 99 illustrates a panel to which the mounting flange 14 is fixed by means of the mounting apertures 15 (FIG. 1). FIG. 2*b* is a sectional view taken along a line IIa—IIa and FIG. 2*c* is a sectional view taken along a line IIc—IIc in FIG. 2*a*.

Referring to FIG. 2*b*, when the coupling 30 has been rotated through 90° in a direction shown by an arrow 121 or in a clockwise direction viewed from the right side in FIG. 2*a*, the rotation protrusions 34 arrive in a position 34*d* shown in phantom lines where the protrusions 34 have abutted against the rotation stoppers 54 and stopped thereat.

Figure 2D:
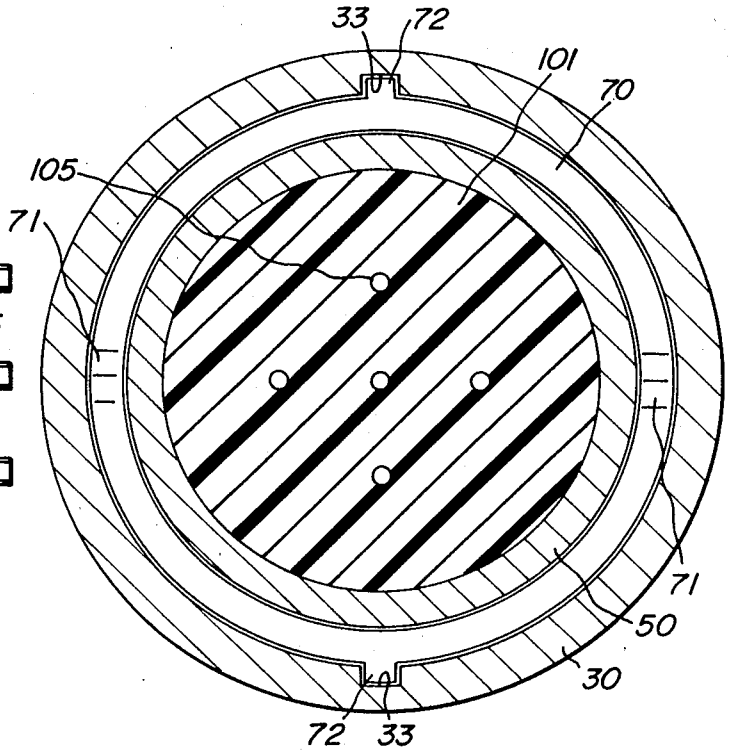
FIG. 2*d* is a sectional view taken along the line IIc—IId in FIG. 2*c;*
Figure 2C:
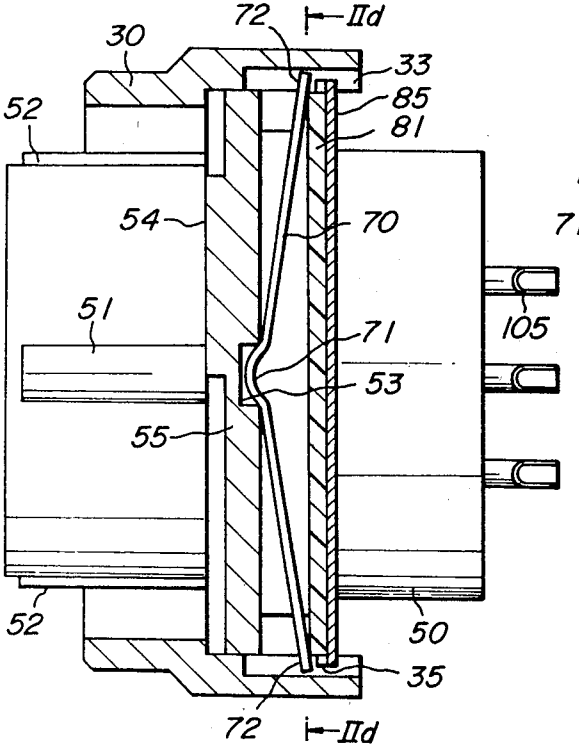
FIG. 2*c* is a sectional view taken along the line IIc—IIc in FIG. 2*a;*

FIG. 2*c* illustrates one of the detent projections 71 of the detent spring ring 70 fitted in the first pair of detent recesses 53. It is understood from FIG. 2*c* that the detent spring ring 70 is restrained by the back-up ring 81 which is in turn prevented by the retainer ring 85 from jumping out (toward the right in FIG. 2*c*) of the coupling 30. It is further understood from FIG. 2*d* which is a sectional view taken along a line IId—IId in FIG. 2*c* that the detent keys 72 are fitted in the detent key ways 33 formed in the inside of the coupling 30 so that when the coupling 30 is forced to rotate, the detent spring ring 70 is rotated together therewith.

Figure 3A:
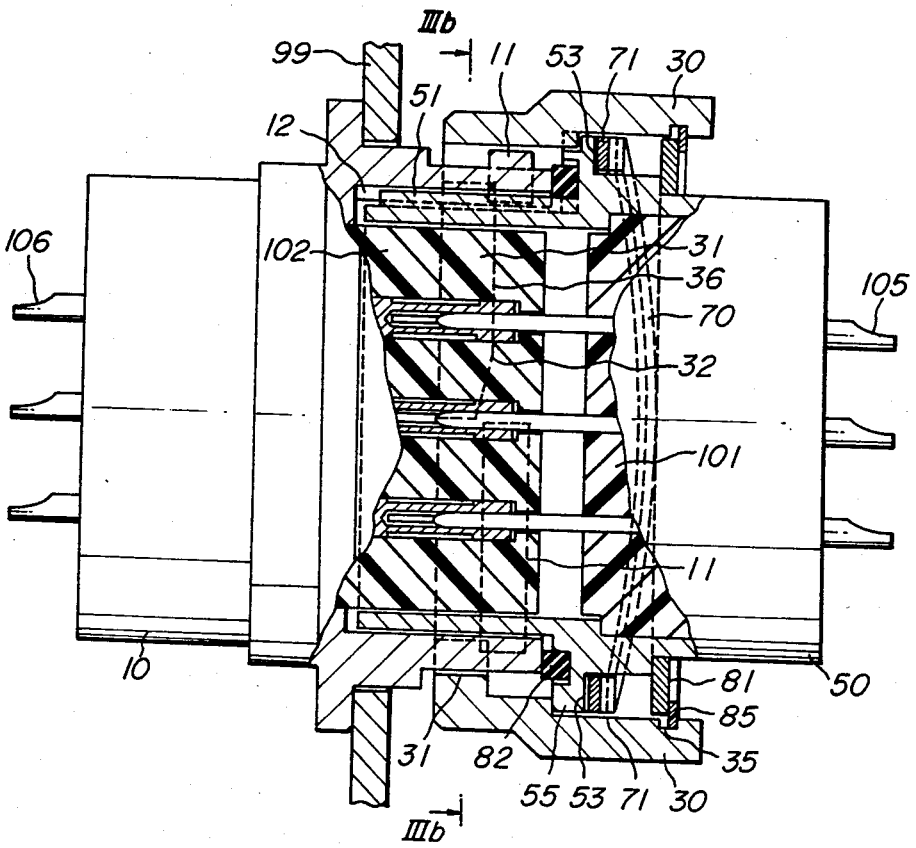
FIG. 3*a* is a partial sectional view illustrating a half fitted condition of the connector.
Figure 3B:
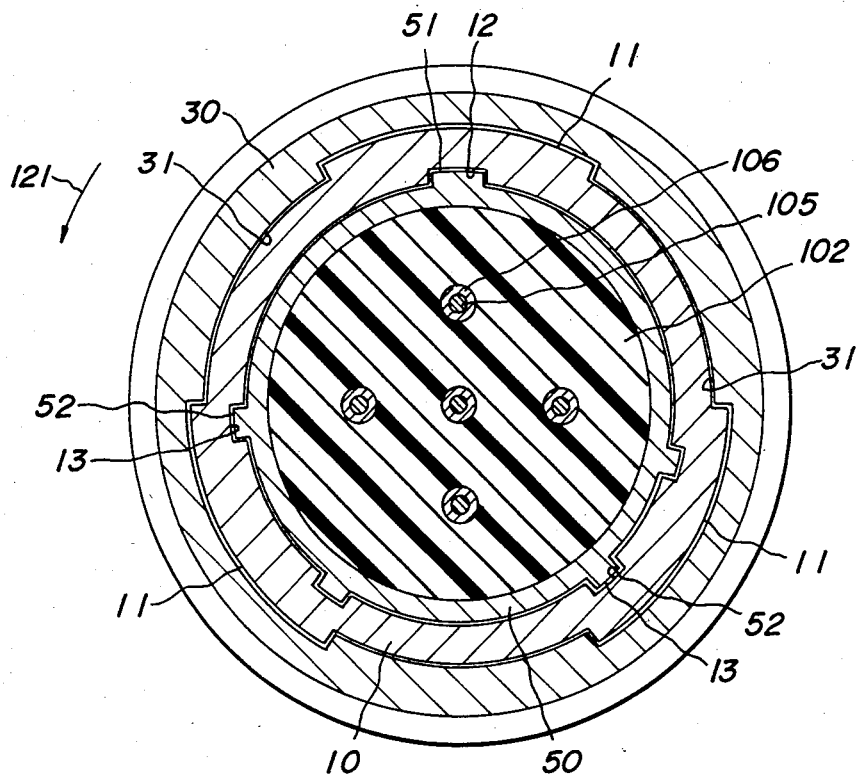
FIG. 3*b* is a sectional view taken along the line IIIb—IIIb in FIG. 3*a;*

FIG. 3*a* is a sectional view illustrating the half fitted condition. A relation between the fixing lands 11 and the tapered lands 31 shown in phantom lines in FIG. 3*a* should be noticed. When the coupling 30 is rotated, the tapered lands 31 are lowered downward viewed in FIG. 3*a* so that upper left-hand corners of the lands 11 viewed in this drawing slide on the tapered portions and arrive at tapered land surface portions 36 contiguous to the tapered portions. With this operation, the coupling 30 and the plug shell fixed thereto are advanced to the left in the drawing to accomplish a complete fitting of the receptacle shell 10 and the plug shell 50. In FIG. 3*b* which is a sectional view taken along a line IIIb—IIb in FIG. 3*a*, the master key 51 has been fitted in the master key groove 12 and the four keys 52 have been fitted in the key ways 13, so that even if the coupling 30 is forced to rotate in the direction 121 or in a direction opposite thereto, the plug shell 50 is not rotated relative to the coupling 30. In this case, moreover, the fixing lands 11 and the tapered lands 31 do not overlap in their axial directions, so that the plug shell 50 can be inserted into or removed from the receptacle shell 10.

Figure 4A:
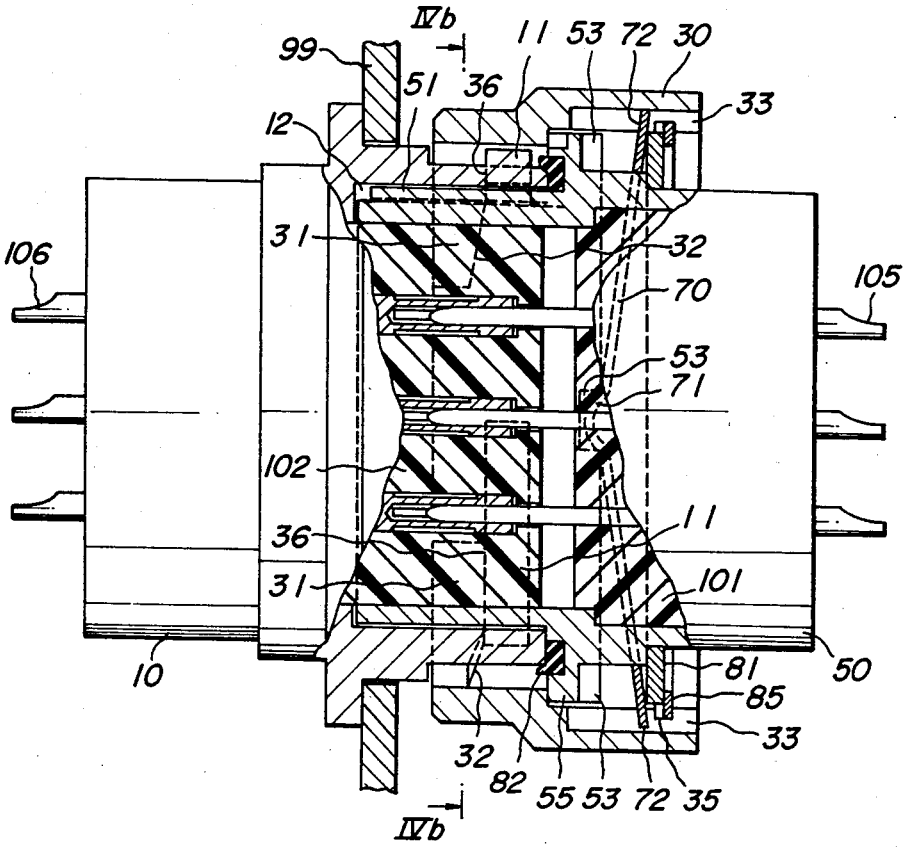
FIG. 4*a* is a sectional view illustrating a completely fitted condition of the connector.

FIG. 4*a* is a partial sectional view illustrating the fitted condition wherein the coupling 30 has been rotated in a clockwise direction viewed from a right side of FIG. 4*a* or from a rear side of the plug shell 50. On the way of this rotation, the tapered portions 32 of the tapered lands 31 in phantom lines are urged against the fixing lands 11 in phantom lines to cause the plug shell 50 to move toward the left viewed in FIG. 4*a*. As a result, the tapered land surface portions 36 of the tapered lands 31 are brought into contact with the fixing lands 11 to complete the movement of the plug shell 50 in the left direction viewed in FIG. 4*a*. At the moment, the detent projections 71 in phantom lines are fitted in the second pair of detent recesses 53 to generate a sound which inform an operator of the completion of connection. Such a sound is referred to herein "reaction". In this manner, the fitting between the number of the pin contacts 105 and the number of the socket contacts 106 is accomplished.

Figure 4B:
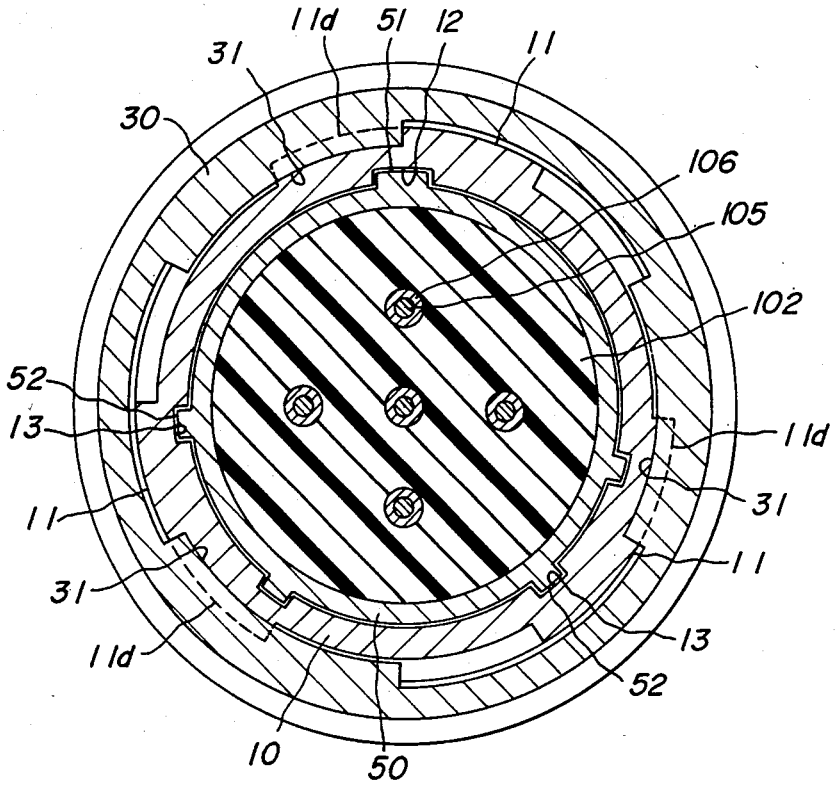
FIG. 4*b* is a sectional view taken along the line IVb—IVb in FIG. 4*a;*

FIG. 4*b* is a sectional view taken along a line IVb—IVb in FIG. 4*a*, illustrating a relative position between the fixing lands 11 and the tapered lands 31. In this condition, parts 11*d* of the fixing lands 11 in phantom lines engage the tapered lands 31 to prevent the plug shell 50 from being removed.

A force required to insert the plug shell 50 into the receptacle shell 10 is not large on the way from the condition before fitted shown in FIGS. 2*a*, 2*b*, 2*c* and 2*d* to the half fitted condition shown in FIGS. 3*a* and 3*b*. On the other hand, a fairly large force is required to bring the half fitted condition into the fitted condition shown in FIGS. 4*a* and 4*b*. The more the numbers of the pin contacts 105 and the socket contacts 106, the larger force are required for the insertion. However, such a large force is obtained by the relative rotating movement between the tapered portions 32 and the fixing lands 11, so that the coupling is rotated only by a slight force.

If it is required to remove the plug shell from the receptacle shell, the procedure above described may be effected in a reverse order. Namely, the coupling 30 is rotated through 90° in a counterclockwise direction viewed from the rear side of the coupling 30 in FIG. 4*a* to bring the condition shown in this drawing into the half fitted condition in FIGS. 3*a* and 3*b*. At the beginning of the rotation of the coupling 30, a somewhat large force is needed in order to remove the detent projections 71 from the second pair of detent recesses 53. After the coupling 30 has been rotated through 90°, the detent projections 71 are fitted in the first pair of detent recesses 53 as shown in FIG. 3*a* to generate a sound which is so-called "reaction". Under this condition, the receptacle shell 10 and the coupling 0 do not have overlapped portions, so that the plug shell can be removed from the receptacle shell 10.

Although the master key 51 and the master key groove 12 have been formed in the plug shell 50 and the receptacle shell 10 respectively, this is only by way of example, and the master key 51 could be formed in the receptacle shell 10 and the master key groove 12 could be formed in the coupling 50. The same holds true in the keys 52 and the key ways 13. In the same manner, positions of the fixing lands 11 and the tapered lands 31 may be replaced. Moreover, tapered portions may be further provided on the fixing lands. The gasket 82 may be provided on the inner surface of the receptacle shell 50 in opposition to a front end of the plug shell 50, instead of providing the gasket 81 on the plug shell 50.

Figure 5A:
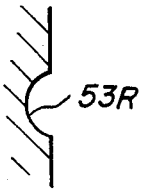
FIGS. 5*a*–5*d* illustrate modifications of the detent spring ring used in the connector.
Figure 5B:
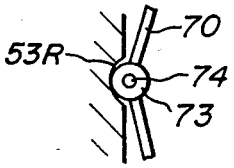
Figure 5C:
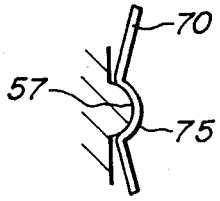

FIGS. 5*a*–5*d* illustrate modifications of the embodiment above described. Circular arc-shaped recesses 53R are formed in a plug flange 55 of a plug shell 50 as shown in FIG. 5*a* instead of the recesses 53 shown in FIG. 2*c*. Instead of the detent projections 71 shown in FIG. 2*c*, cylindrical rotatable detent bushes 73 may be supported by detent bush pins 74 provided on a detent spring ring 70 as shown in FIG. 5*b*. Moreover, they may be modified to have detent projections 57 and detent recesses 75 as shown in FIG. 5*c*. Although the detent spring ring 70 shown in FIG. 1 has been shown as the shape forming an angle about a line connecting the two detent projections 71 to have a springiness in itself (FIG. 2*c*), it may consist of a flat detent spring ring 70*b* and a waved spring ring 76 reinforcing the flat ring 70*b*. Instead of the waved spring ring 76, a coil spring may be used.

As the detent projections 71 extend in parallel with an axis of the detent spring rings, the detent recesses are depressed in the axial direction, so that maximum outer diameters of the plug shell 50 and the coupling 30 can be small.

Figure 6:
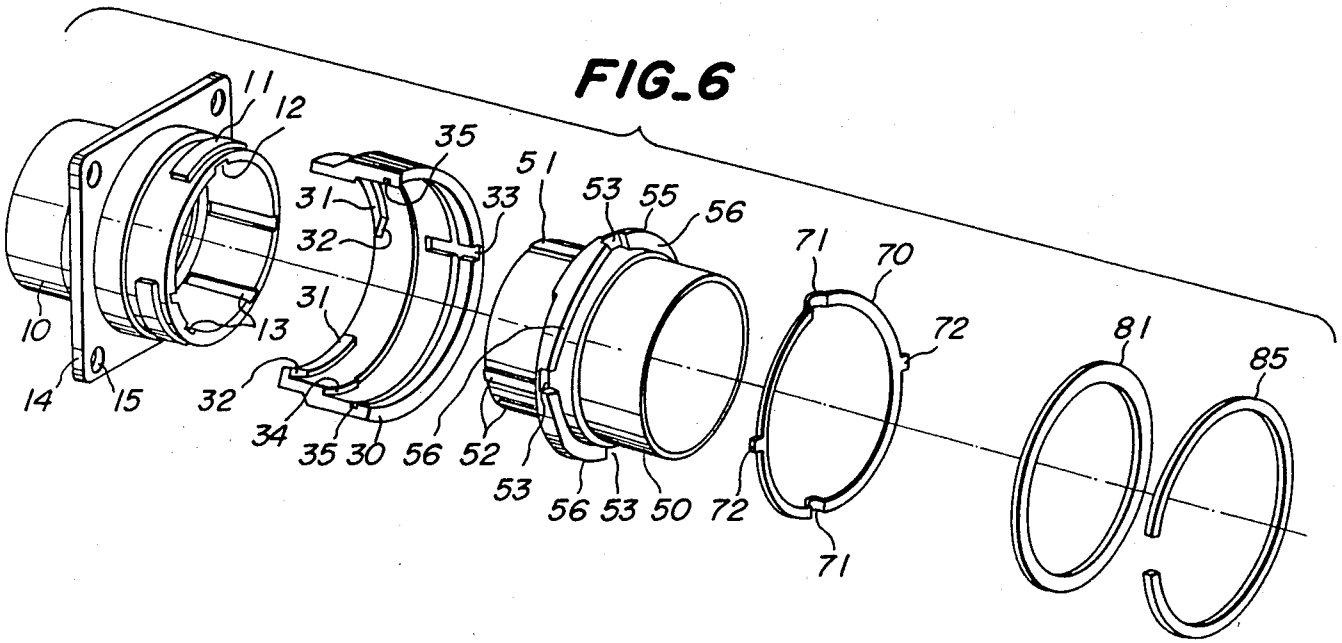
FIG. 6 is an exploded perspective view of a second embodiment of the invention.

FIG. 6 illustrates a second embodiment of the invention in an exploded perspective view.

As this embodiment is similar to the first embodiment above described, different features from the first embodiment will be explained hereinafter. In this embodiment, a plug flange 55 is formed with four detent recesses 53 similar to those in the first embodiment and is further formed with four circular arc surfaces 56 between the four detent recesses 53.

Figure 7:
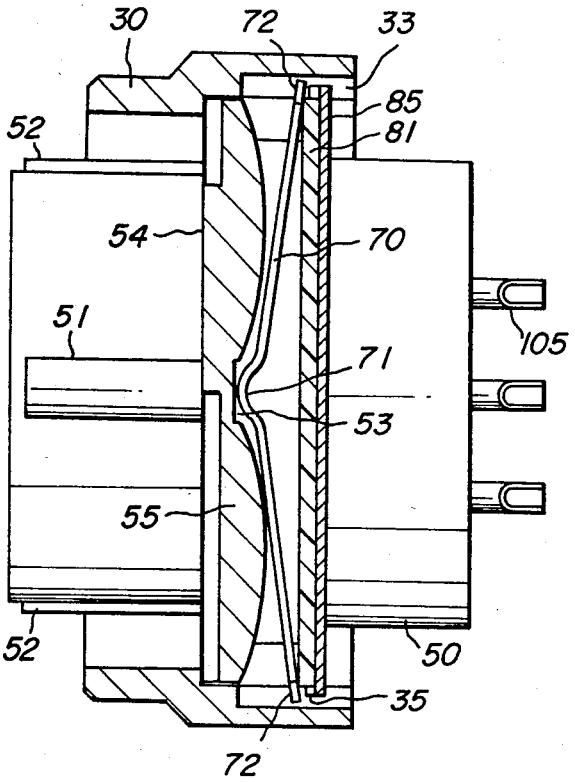
FIG. 7 is a sectional view of the connector shown in FIG. 6 before fitting, corresponding to FIG. 2*c;*

The shape of the circular arc surfaces 56 is clearly shown in FIG. 7 illustrating detent projections 71 of a detent spring ring 70 fitted in the first pair of detent recesses 53. The portions of the plug flange 55 have a maximum thickness at the mid-portion between the adjacent recesses 53. In other words, the portions of the plug flange 55 between the adjacent detent recesses 53 progressively decrease their thichkness from the mid-portions toward the adjacent recess 53 to form circular arc surfaces 56 in circular directions of the flange 55. The detent recesses 53 are located at the bottom of the circular arc surfases 56.

Figure 8:
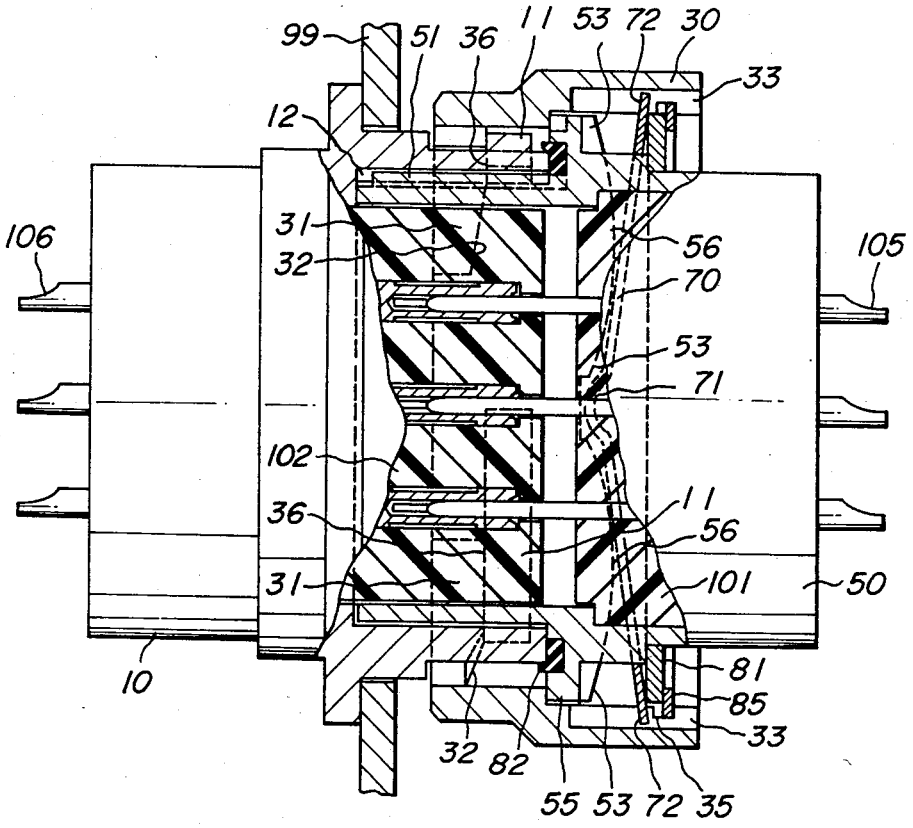
FIG. 8 is a partial sectional view of the connector illustrating a completely fitted condition of the connector.

FIG. 8 is a partial sectional view illustrating the fitted condition of a receptacle shell 10 and a plug shell 50. When the coupling 30 is being rotated to bring the shells 10 and 50 into the fitted condition, detent projections 71 in phantom lines slide on the circular arc surfaces 56 to be fitted in the second pair of detent recesses 53 so as to generate a sound.

A force required to bring a half fitted condition into the fitted condition can be reduced as in the first embodiment. Such a force is obtained by a relative rotating movement between tapered portions 32 and fixing lands 11 and further the detent projections 71 slide on inclined surfaces of the circular arc surfaces 56 and fall into the detent recesses 53 at bottoms of the inclined surfaces, so that the coupling is rotated only by a slight force.

In removing the plug shell, after the coupling 30 has been rotated through 90°, the detent projections 71 slide on the circular arc surfaces 56 and are fitted in the first pair of detent recesses 53 in the same manner shown in FIG. 3*a* to generate a sound clearly showing so-called "reaction".

It is understood that instead of the circular arc surfaces 56, mountain-like surfaces may be used, which consists of two inclined straight surfaces.

Figure 9:
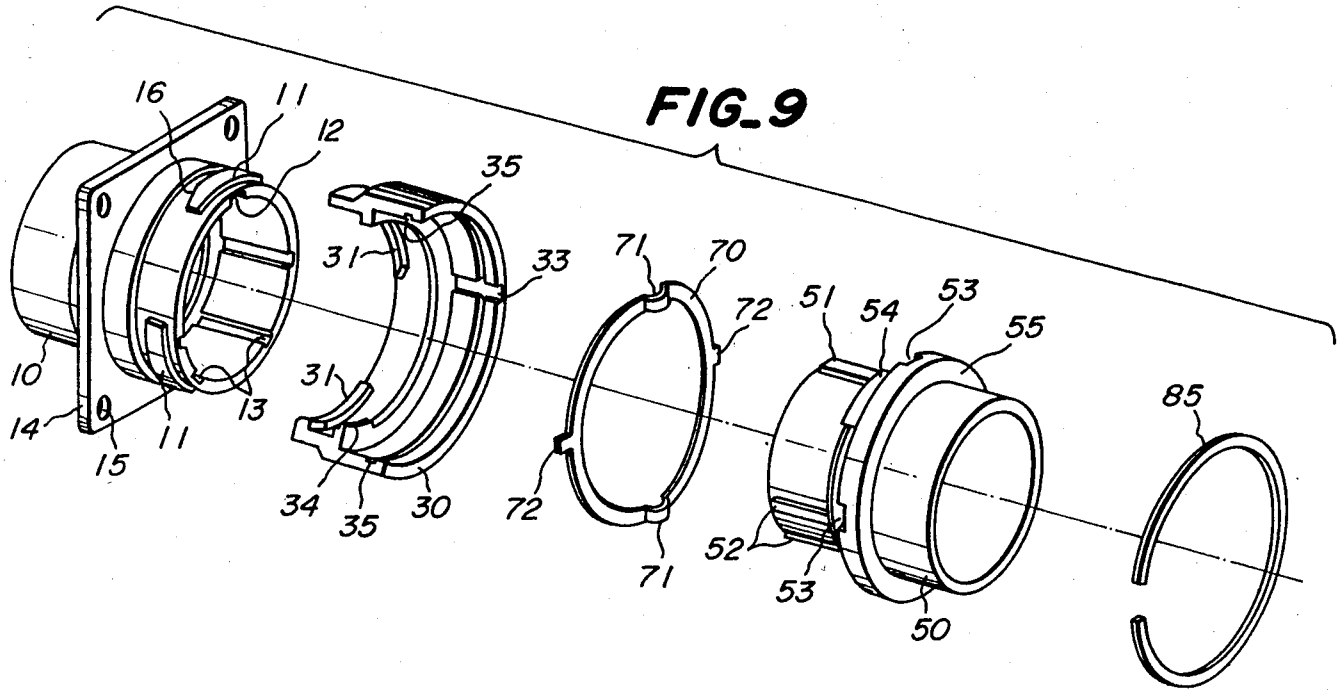
FIG. 9 is an exploded perspective view of a third embodiment of the invention.

FIG. 9 illustrates a third embodiment of the invention in an exploded perspective view.

As this embodiment is similar to the first embodiment above described with exception that the positions of the plug shell 50 and the detent spring ring 70 are reversed as is clear in comparison with FIGS. 1 and 9 and other features described herein.

As shown in FIG. 9, three lands 11 on a receptacle shell 10 have tapered portions 16, and corresponding thereto, rotation lands 31 on a coupling 30 do not have tapered portions and are in the form of a circular arc extending inwardly and circumferentially. Furthermore, rotation protrusions 34 are formed extending inwardly so as to abut against rotation stoppers 54 of the plug shell 50 to prevent it from rotating.

As shown in FIG. 9, two detent projections 71 of a detent spring ring 70 extend on the right side viewed in this drawing.

The plug shell 50 is formed with four detent recesses 53 opening toward the receptacle shell and with two rotation stoppers 54 located inwardly of a plug flange 55 and extending in an axial direction of the plug shell 50 toward the receptacle shell 10.

A retainer ring 85 as back-up means is adapted to be fitted in a retainer ring groove 35 in the coupling 30 to prevent the plug shell 50 from removing toward on a rear side or the right side viewed in FIG. 9.

Figure 10A:
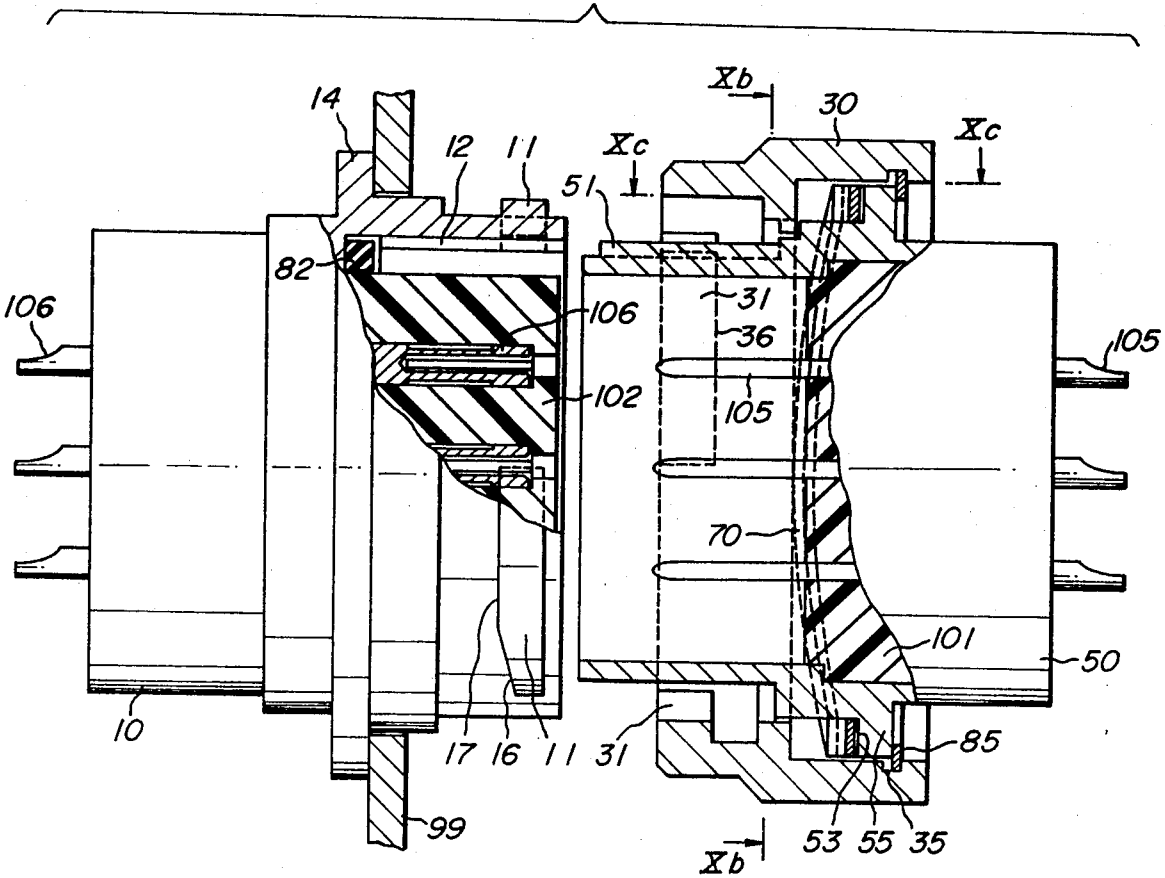
FIG. 10*a* is a partial sectional view of the connector before fitting.
Figure 10B:
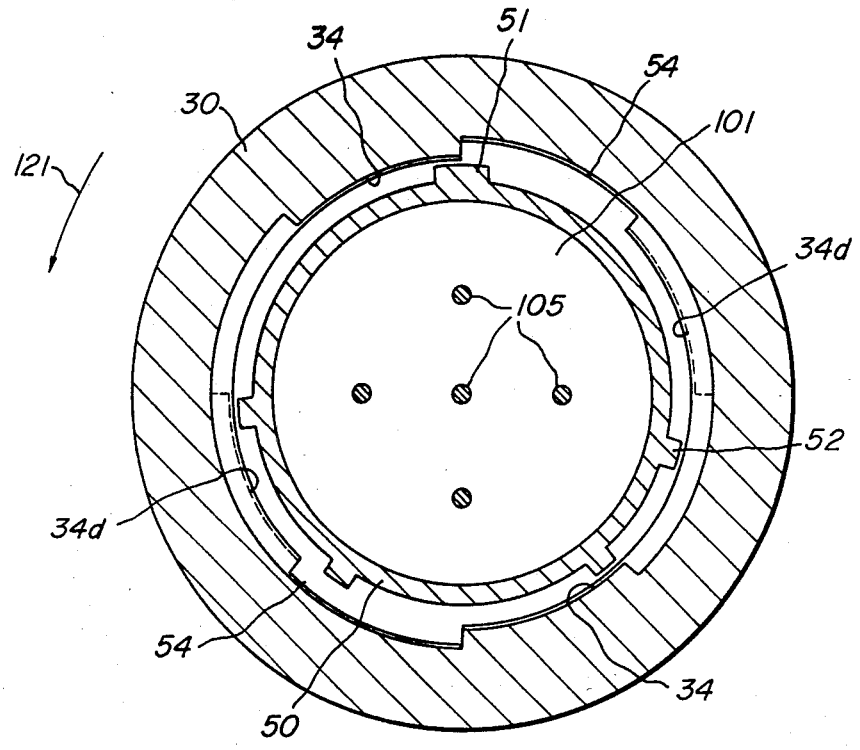
FIG. 10*b* is a sectional view taken along the line Xb—Xb in FIG. 10*a;*
Figure 10D:
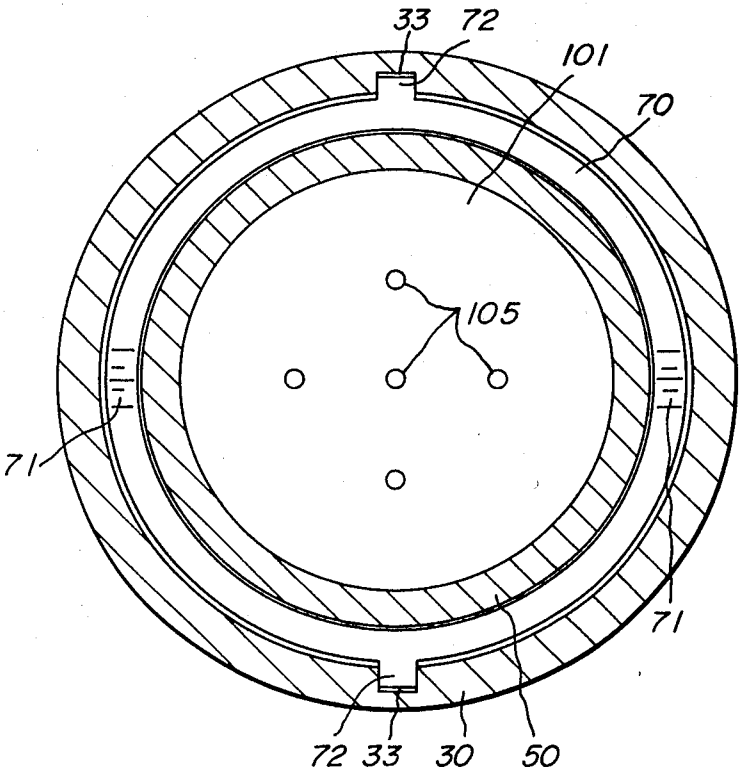
FIG. 10*d* is a sectional view taken along the line Xd—Xd in FIG. 10*c;*
Figure 10C:
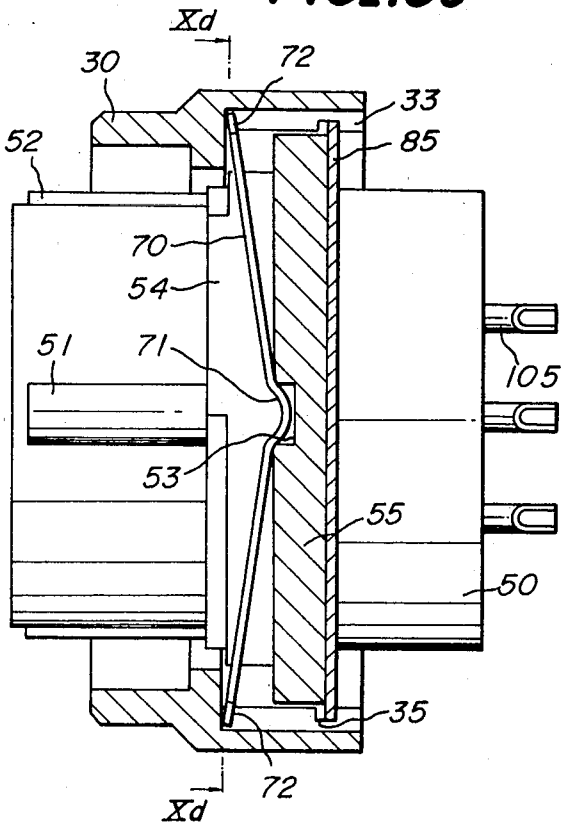
FIG. 10*c* is a sectional view taken along the line Xc—Xc in FIG. 10*a;*

FIGS. 10*a*–10*d* correspond to FIG. 2*a*–2*d* of the first embodiment above described. Referring to FIG. 10*c*, the detent spring ring 70 is embraced between the coupling 30 and the plug shell 50, and the plug shell 50 is prevented from removing toward the right viewed in the drawing with the aid of the retainer ring 85 fitted in the retainer ring groove 35 of the coupling 30.

Figure 11:
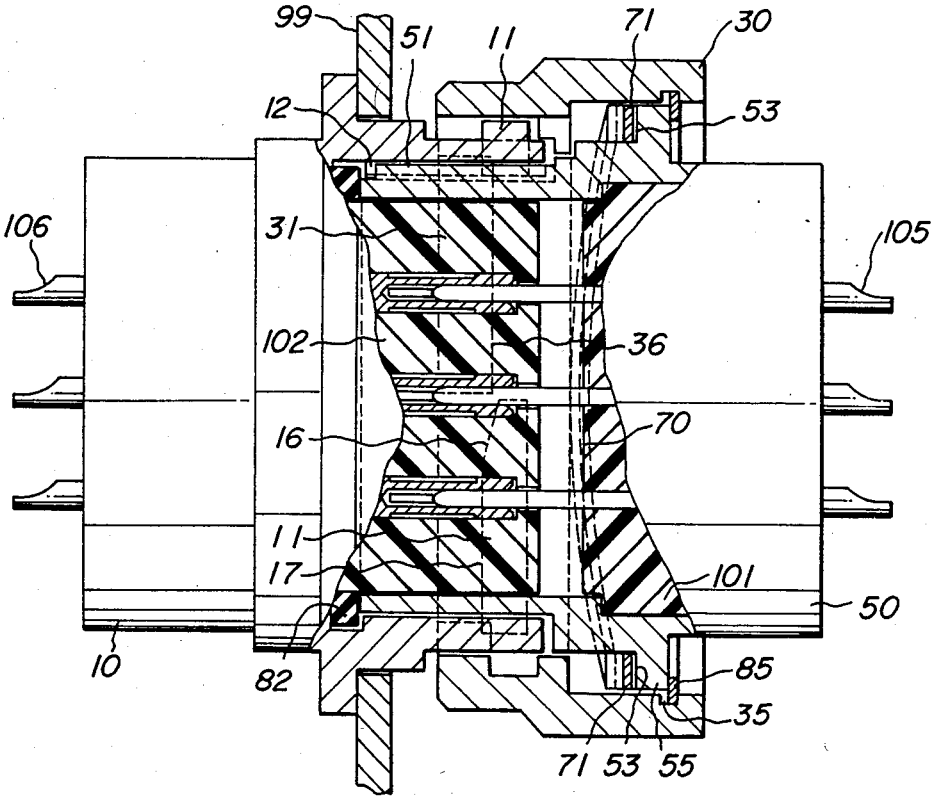
FIG. 11 is a partial sectional view illustrating a half fitted condition of the connector.
Figure 12:
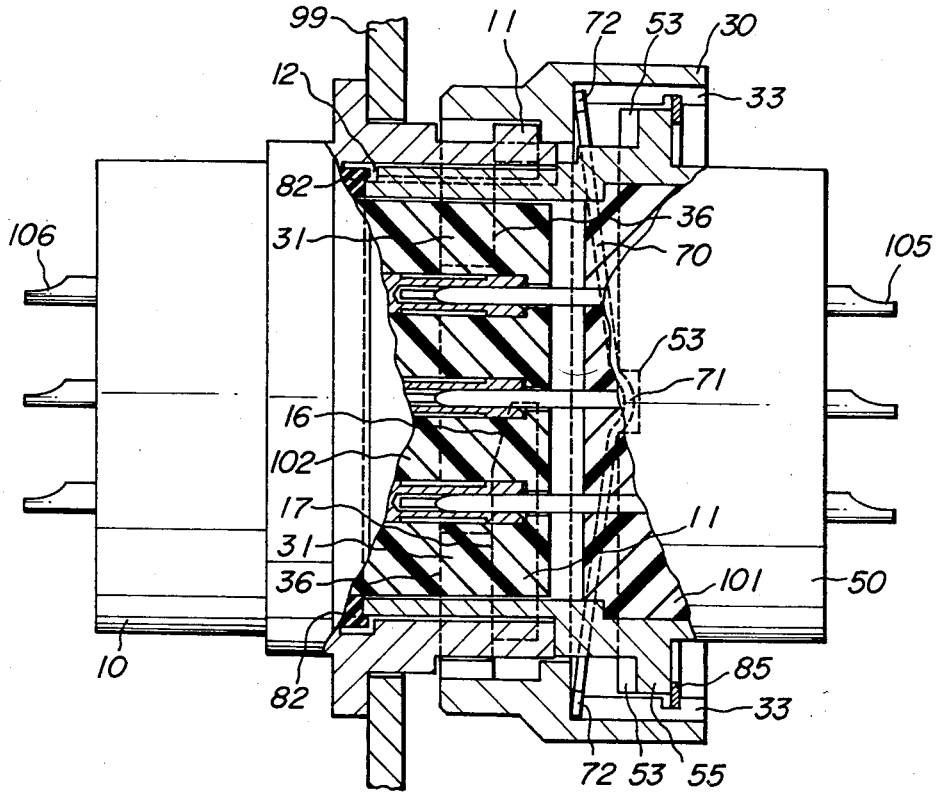
FIG. 12 is a partial sectional view illustrating a completely fitted condition of the connector.

Referring to FIG. 11, when the coupling 30 is being rotated to bring the shells 10 and 50 into the fitted condition, the tapered portions 16 of the tapered lands 11 slide on flat surface portions 36 of the rotation lands 31 and the flat surface portions 36 arrive at taper land flat surfaces 17 contiguous to the tapered portions 16, thereby enabling the coupling 30 and the plug shell 50 fixed thereto to move toward the left of the drawing to achieve the complete fitting condition as shown in FIG. 12.

In this embodiment, tapered portions may be further provided on the rotation lands 31.

Figure 5D:
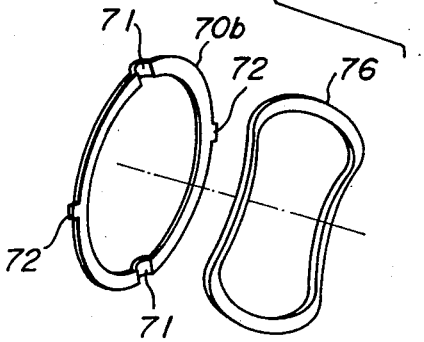
Figure 13:
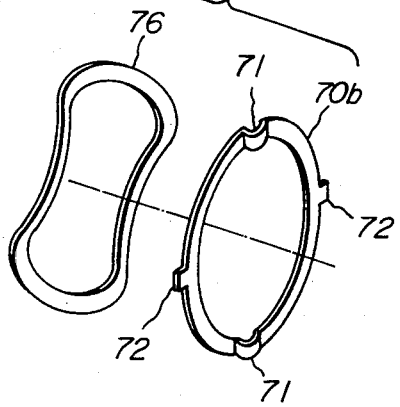
FIG. 13 is a perspective view of a modified detent spring ring.

FIG. 13 illustrates a modification of the detent spring ring denoted by 70*b* corresponding to that shown in FIG. 5*d*. In this embodiment, a waved spring ring 76 is arranged on the left side of the detent spring ring 70*b* or on the side of the receptacle shell 10.

Figure 14:
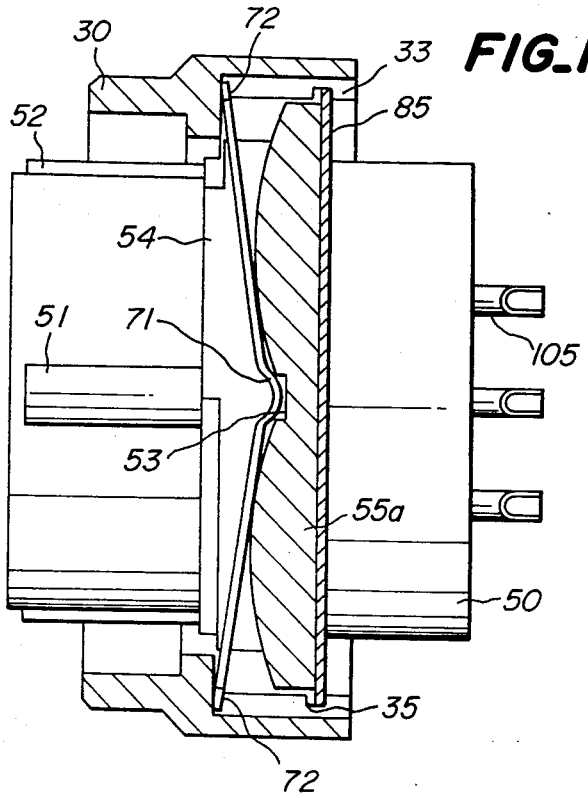
FIG. 14 is a partial sectional view illustrating a further embodiments of the Invention.

Moreover, portions of the plug flange 55 between the detent recesses 53 may be formed in circular arc surfaces as in the second embodiment to facilitate the sliding of the detent projections 71 thereon, thereby making more clear the reaction of insertion and removal and making small the rotating force required therefor (FIG. 14).

As can be seen from the above description, the present invention can provide an improved connector which is prevented from disconnection due to vibration or the like and is easy and inexpensive to manufacture with less number of parts to bring a significant effect for the industry.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A locked connector for use in electric connectors, optical fiber connectors and the like, including receptacle means having a recetacle shell, coupling means engaging the receptacle means with relative rotations, plug shell means having a plug shell engaging the receptacle shell with relative movements in their axial directions but against relative rotation, back-up means permitting said coupling means and said plug shell means to rotatably engage with each other, and detent means for holding said receptacle means and said plug shell means in their fitted position and permitting said receptacle means and said plug shell means to disengage from the fitted position by rotating said coupling means relative to said plug shell means with a force, said detent means comprising:

a detent ring encircling said plug shell means and having means for rotating together with said coupling means to form a detent mechanism in connection with said plug shell, and spring means for urging said detent ring toward said plug shell; said detent ring provided with detent projections extending in an axial direction of the detent ring; said plug shell including a plug flange encircling the plug shell, said plug flange being formed with a plurality of detent recesses for receiving said detent projections of said detent ring to form said detent means; said plug flange provided with surfaces in opposition to said detent ring, said surfaces each having a mid-portion between said adjacent detent recesses and having a progressively decreased thickness from said mid-portion to the adjacent detent recesses to form a plurality of circular surfaces about the circumference of the plug flange, said detent recesses located at the bottoms of said circular arc surface.

2. A locked connector as set forth in claim 1, wherein said detent projections of the detent ring are two and located in diametrically opposed poitions, and said detent recesses of the plug flange are four and located at four positions equally spaced on the plug flange.

3. A locked connector as set forth in claim 2, wherein said detent ring is bent to form an angle about a line connecting said tow detent projections to have a springiness, thereby integtally forming said detent ring and said spring means.

4. A locked connector as set forth in claim 1, wherein said detent ring is provided with rotatable bushes supported by detent bush pins provided on the detent ring to form said detent projections.

5. A locked connector as set forth in claim 1, wherein said spring means for urging said detent ring toward said plug shell is a waved spring ring located in close proximty of said detent ring.

* * * * *